US011358403B2

(12) United States Patent
Ohba

(10) Patent No.: US 11,358,403 B2
(45) Date of Patent: Jun. 14, 2022

(54) WEB LOADER, CONVEYOR, DRYER, AND PRINTER

(71) Applicant: Tetsuya Ohba, Kanagawa (JP)

(72) Inventor: Tetsuya Ohba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 119 days.

(21) Appl. No.: 16/878,360

(22) Filed: May 19, 2020

(65) Prior Publication Data

US 2020/0398588 A1 Dec. 24, 2020

(30) Foreign Application Priority Data

Jun. 19, 2019 (JP) ..... JP2019-113303

(51) Int. Cl.

| | |
|---|---|
| ***B41J 11/00*** | (2006.01) |
| ***B41J 11/22*** | (2006.01) |
| ***B41J 15/04*** | (2006.01) |
| ***B41J 15/06*** | (2006.01) |

(52) U.S. Cl.

CPC ..... *B41J 15/046* (2013.01); *B41J 11/0022* (2021.01); *B41J 11/0024* (2021.01); *B41J 11/22* (2013.01); *B41J 15/042* (2013.01); *B41J 15/06* (2013.01)

(58) Field of Classification Search

CPC ..... B41J 11/022; B41J 11/22; B41J 15/042; B41J 15/046; B41J 15/06

See application file for complete search history.

(56) References Cited

U.S. PATENT DOCUMENTS

| | | | | |
|---|---|---|---|---|
| 2002/0033106 | A1 | 3/2002 | Ohba et al. | |
| 2003/0053833 | A1 | 3/2003 | Kinoshita et al. | |
| 2013/0258021 | A1* | 10/2013 | Fuchioka | B41J 15/04 347/104 |
| 2014/0043390 | A1* | 2/2014 | Maeda | B41J 15/04 347/19 |

FOREIGN PATENT DOCUMENTS

| | | |
|---|---|---|
| JP | 60-099655 | 6/1985 |

* cited by examiner

*Primary Examiner* — Matthew Luu
*Assistant Examiner* — Kendrick X Liu
(74) *Attorney, Agent, or Firm* — Duft & Bornsen, PC

(57) ABSTRACT

A web loader includes a web holder configured to hold a web, a traction member configured to hold the web holder and travel along a loading path of the web, a drive rotation body configured to drive the traction member to travel, and a limiter configured to limit a drive force applied to the drive rotation body.

20 Claims, 12 Drawing Sheets

FIG. 8

| ITEMS | | DRIVE FORCE (CHAIN TRANSMISSION POWER) | | | | REMARKS |
|---|---|---|---|---|---|---|
| | | 850 | 550 | 450 | 350 | |
| DAMAGE ON MECHANISM | | DAMAGED | NOT DAMAGED | NOT DAMAGED | NOT DAMAGED | OCCURRENCE OF DEFORMATION OF HOLDING SHAFT, DETACHMENT OF CHAIN, ETC. |
| CONVEY-ANCE FORCE | THIN PAPER | SUFFICI-ENT | SUFFICI-ENT | SUFFICI-ENT | SUFFICI-ENT | BASIS WEIGHT 80gsm |
| | THICK PAPER | SUFFICI-ENT | SUFFICI-ENT | SUFFICI-ENT | INSUF-FICIENT | BASIS WEIGHT 250gsm |

WEB LOADER, CONVEYOR, DRYER, AND PRINTER

CROSS-REFERENCE TO RELATED APPLICATION

This patent application is based on and claims priority pursuant to 35 U.S.C. § 119(a) to Japanese Patent Application No. 2019-113303, filed on Jun. 19, 2019, in the Japan Patent Office, the entire disclosure of which is hereby incorporated by reference herein.

BACKGROUND

Technical Field

Aspects of the present disclosure relate to a web loader, a conveyor, a dryer, and a printer.

Related Art

A printer discharges a liquid on a web such as continuous sheet to print an image on the web. The printer includes a dryer that heats the web with a heater while conveying the web along a winding nonlinear conveyance path after application of the liquid on the web to dry the liquid on the web. In such a dryer, the web has to be initially loaded while setting the web on a complicated (winding nonlinear) conveyance path.

SUMMARY

In an aspect of this disclosure, a web loader includes a web holder configured to hold a web, a traction member configured to hold the web holder and travel along a loading path of the web, a drive rotation body configured to drive the traction member to travel, and a limiter configured to limit a drive force applied to the drive rotation body.

In another aspect of this disclosure, a web loader includes a web holder configured to hold a web, a traction member configured to hold the web holder and travel along a loading path of the web, a drive rotation body configured to drive the traction member to travel, and a restriction member configured to restrict detachment of the traction member from the drive rotation body.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein:

FIG. 8 is a table illustrating an example of an operation torque of a torque limiter according to the first embodiment of the present disclosure;

Figure 1:
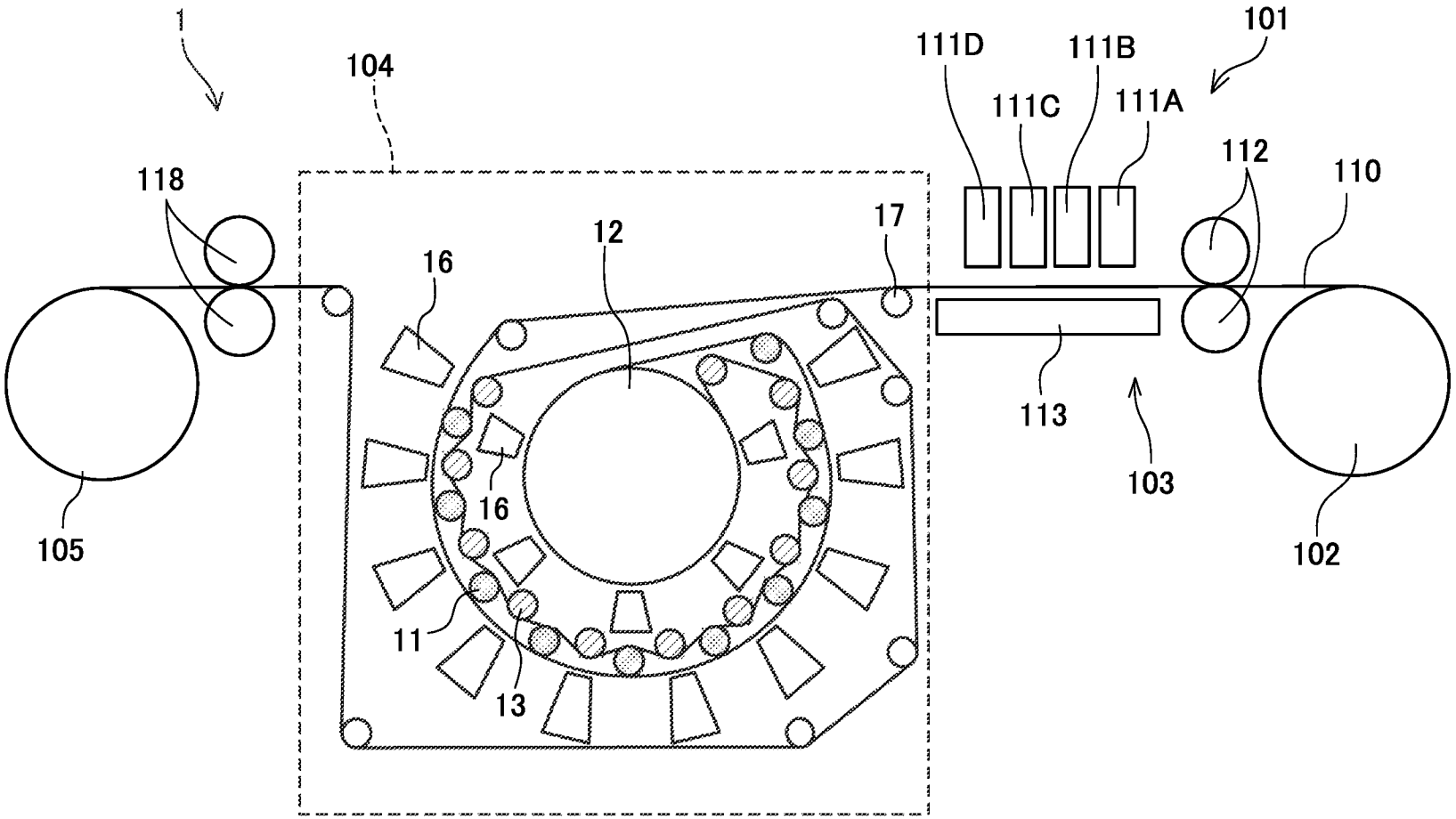
FIG. 1 is a schematic side view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. First, a printer according to a first embodiment of the present disclosure is described with reference to FIG. 1. FIG. 1 is a schematic perspective view of the printer 1.

The printer 1 is an inkjet recording apparatus. The printer 1 includes a liquid application device 101 including a liquid discharge head, which is a liquid applicator, to discharge and apply ink, which is a liquid of desired color, onto a continuous sheet 110 as a web. The continuous sheet 110 is a printing object (drying object or loading object).

The liquid application device 101 includes, for example, full-line heads 111A, 111B, 111C, and 111D for four colors arranged from an upstream side in a conveyance direction of the continuous sheet 110. The full-line heads 111A, 111B, 111C, and 111D apply liquids of black K, cyan C, magenta M, and yellow Y onto the continuous sheet 110, respectively. Note that the number and types of color are not limited to the above-described four colors of K, C, M, and Y and may be any other suitable number and types.

The continuous sheet 110 is fed from a feeding roller 102, sent onto a conveyance guide 113 by conveyance rollers 112 of a conveyance unit 103, and guided and conveyed (moved) by the conveyance guide 113. The conveyance guide 113 is disposed to face the liquid application device 101.

The continuous sheet 110 to which the liquid has been applied by the liquid application device 101 passes through a dryer 104 including a web loader 200 according to an embodiment of the present disclosure. A pair of sheet ejection rollers 118 further conveys the continuous sheet 110, and a winding roller 105 winds the continuous sheet 110.

Figure 2:
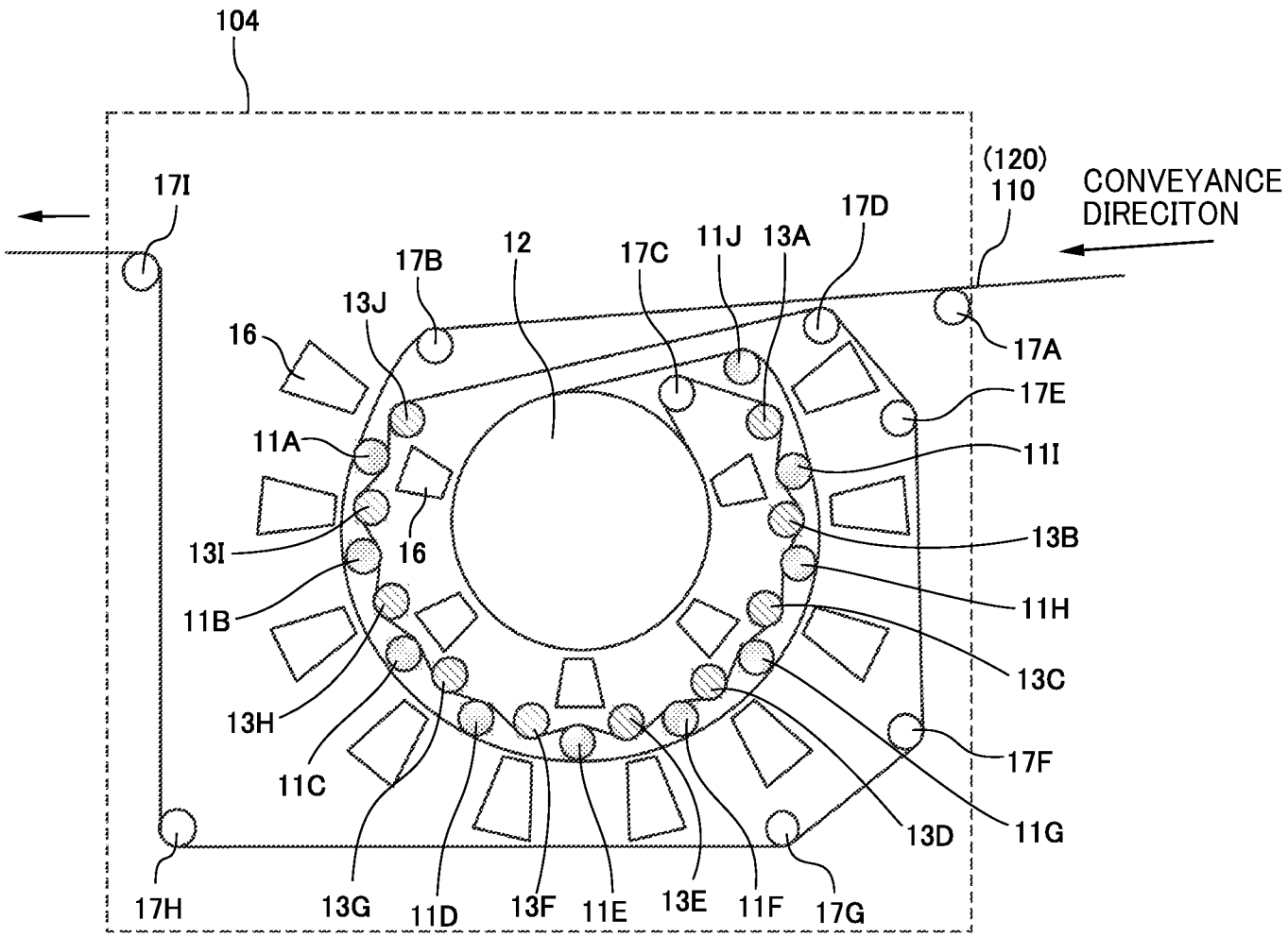
FIG. 2 is enlarged cross-sectional view of a dryer according to the first embodiment of the present disclosure.

Next, the dryer 104 according to a first embodiment of the present disclosure is described with reference to FIG. 2. FIG. 2 is an enlarged schematic cross-sectional view of the dryer 104.

The dryer 104 includes heating rollers 11 (11A to 11J), which are ten rotating bodies, and a heating drum 12. The heating rollers 11 and the heating drum 12 constitute a contact heating unit to contact and heat the continuous sheet 110. Further, the dryer 104 includes ten guide rollers 13 (13A to 13J) to guide the continuous sheet 110 so that the continuous sheet 110 is pressed against the heating rollers 11A to 111. The heating rollers 11 and the heating drum 12 are rotating bodies that guide and convey the continuous sheet 110 (web). The heating rollers 11 and the heating drum 12 serves as heating rotating bodies.

The dryer 104 further includes two guide rollers 17A and 17B to guide the continuous sheet 110 to the heating roller 11A, one guide roller 17C to wind the continuous sheet 110 around the heating drum 12, and five guide rollers 17D to 17I that guide the continuous sheet 110 exiting from the heating roller 11A outside the dryer 104 (apparatus body).

The plurality of heating rollers 11A to 11J is in a substantially arc-shaped arrangement around the heating drum 12. Note that the diameters of the heating rollers 11A to 11J can be identical to or different from each other. Further, the guide rollers 13L to 13J are disposed between the adjacent heating rollers 11.

The plurality of heating rollers 11, the heating drum 12, and the plurality of guide rollers 13 constitute a heating conveyance path (conveyance path) to heat the continuous sheet 110. The continuous sheet 110 is conveyed to the plurality of the heating rollers 11 upstream from the heating drum 12 while the continuous sheet 110 contacts the outer circumference of the plurality of the heating rollers 11 arranged in an arc-shape. The "outer circumferential of the plurality of heating rollers 11" represents an outer circumference of the plurality of heating rollers 11 that contacts the continuous sheet 110 on the conveyance path disposed outside the plurality of heating rollers 11 with respect the center of the dryer 104.

Then, the continuous sheet 110 is conveyed to the heating drum 12 and is conveyed again to the plurality of the heating rollers 11 while the continuous sheet 110 contacts the inner circumference of the plurality of the heating rollers 11 by the plurality of guide rollers 13. The "inner circumferential of the plurality of heating rollers 11" represents the inner circumference of the plurality of heating rollers 11 that contacts the continuous sheet 110 on the conveyance path disposed interior of the plurality of heating rollers 11 with respect the center of the dryer 104.

Thus, a plurality of identical heating rollers 11 of the dryer 104 according to the present embodiment contacts and heats the continuous sheet 110 from different directions, that is, a direction from a liquid application surface and a direction from a surface opposite the liquid application surface of the continuous sheet 110.

The dryer 104 includes a plurality of hot air fans 16 as a non-contact heating unit to heat the continuous sheet 110 from the liquid application surface side on an outer peripheral side of the arrangement of the plurality of heating rollers 11. The dryer 104 also includes a plurality of hot air fans 16 around the heating drum 12.

With the above-described configuration, the dryer 104 heats the continuous sheet 110 with the plurality of heating rollers 11 contacting the surface opposite the liquid application surface of the continuous sheet 110 while blowing hot air toward the liquid application surface of the continuous sheet 110 with the hot air fans 16 to heat the liquid application surface of the continuous sheet 110 to dry the continuous sheet 110.

Then, the heating drum 12 arranged inside the plurality of heating rollers 11 contacts and heats the surface opposite the liquid application surface of the continuous sheet 110 while blowing the hot air onto the liquid application surface of the continuous sheet 110 with the hot air fans 16 to heat the liquid application surface of the continuous sheet 110.

Then, the dryer 104 heats the surface opposite to the liquid application surface of the continuous sheet 110 with the plurality of heating rollers 11 again while the guide rollers 13 contacting the liquid application surface of the continuous sheet 110 to dry the liquid applied on the continuous sheet 110. Then, the dryer 104 transfers the continuous sheet 110 to a next stage with the guide rollers 17D to 17I.

The dryer 104 includes a conveyance path 120 of the continuous sheet 110, a path of which is indicated by the continuous sheet 110. To simplify the drawing, the continuous sheet 110 and the conveyance path 120 are illustrated by the same line. The plurality of heating rollers 11 and the plurality of guide rollers 13 configure a heating conveyance path meandering in the dryer 104.

Figure 3:
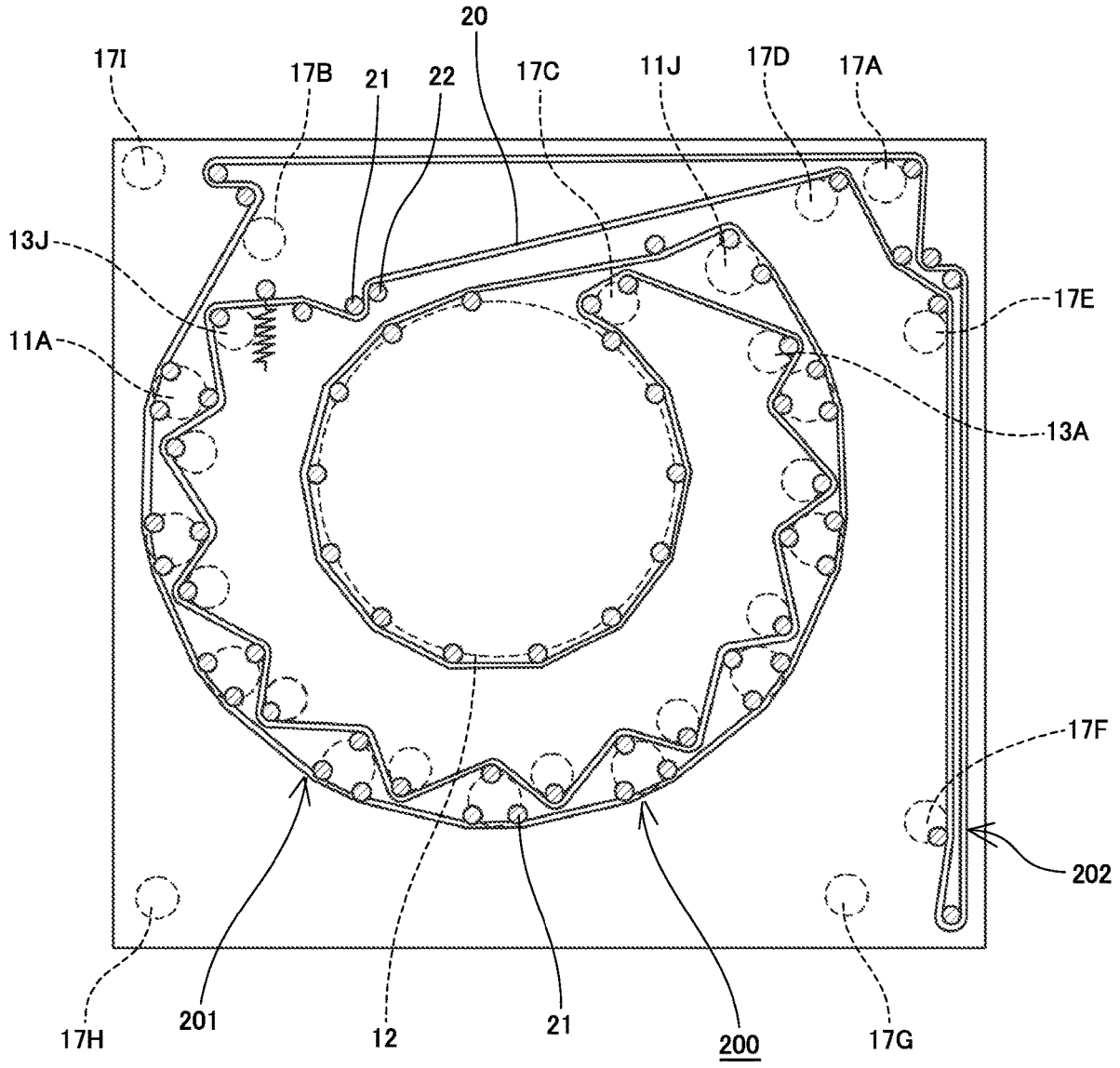
FIG. 3 is a schematic cross-sectional view of a web loader according to a first embodiment of the present disclosure.
Figure 4:
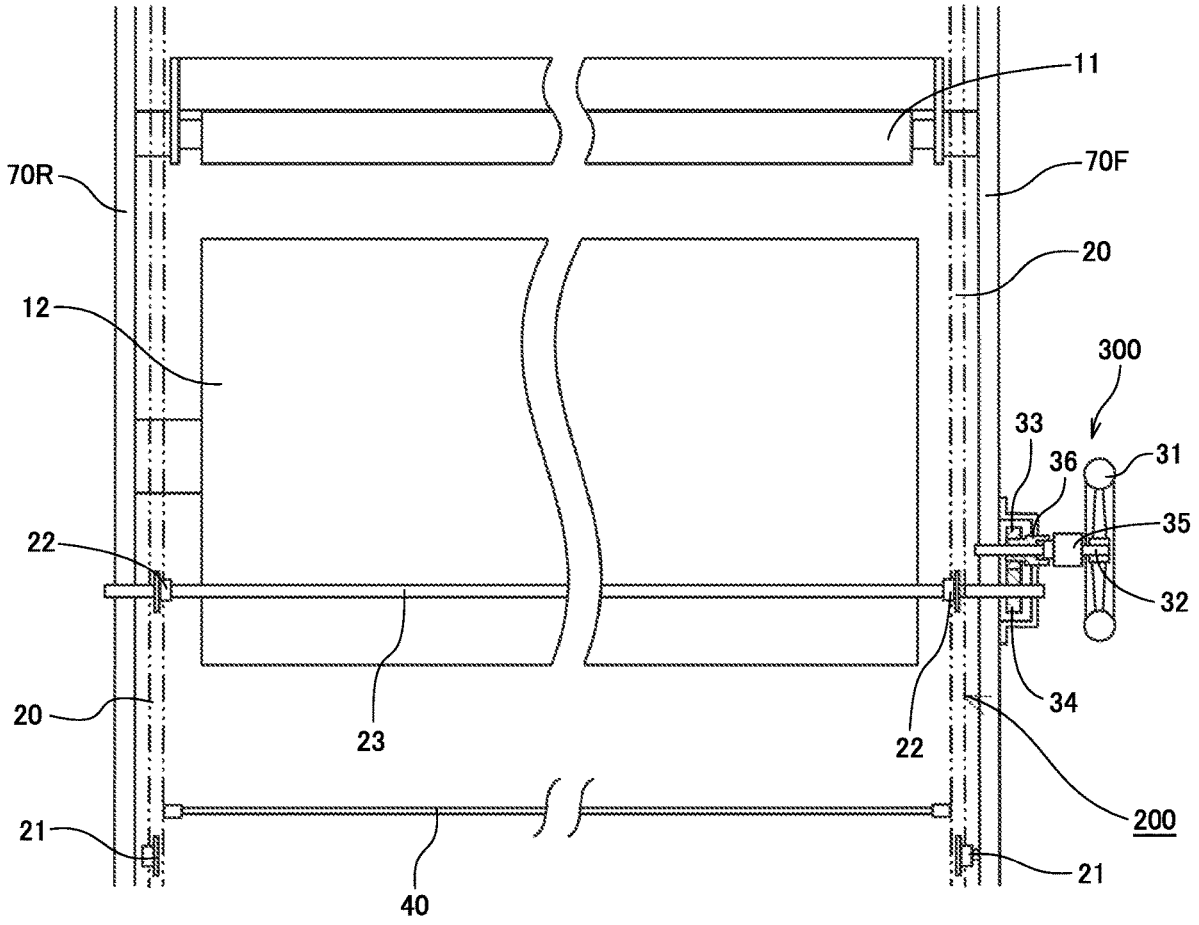
FIG. 4 is an enlarged schematic plan view of a main portion of the web loader.
Figure 5:
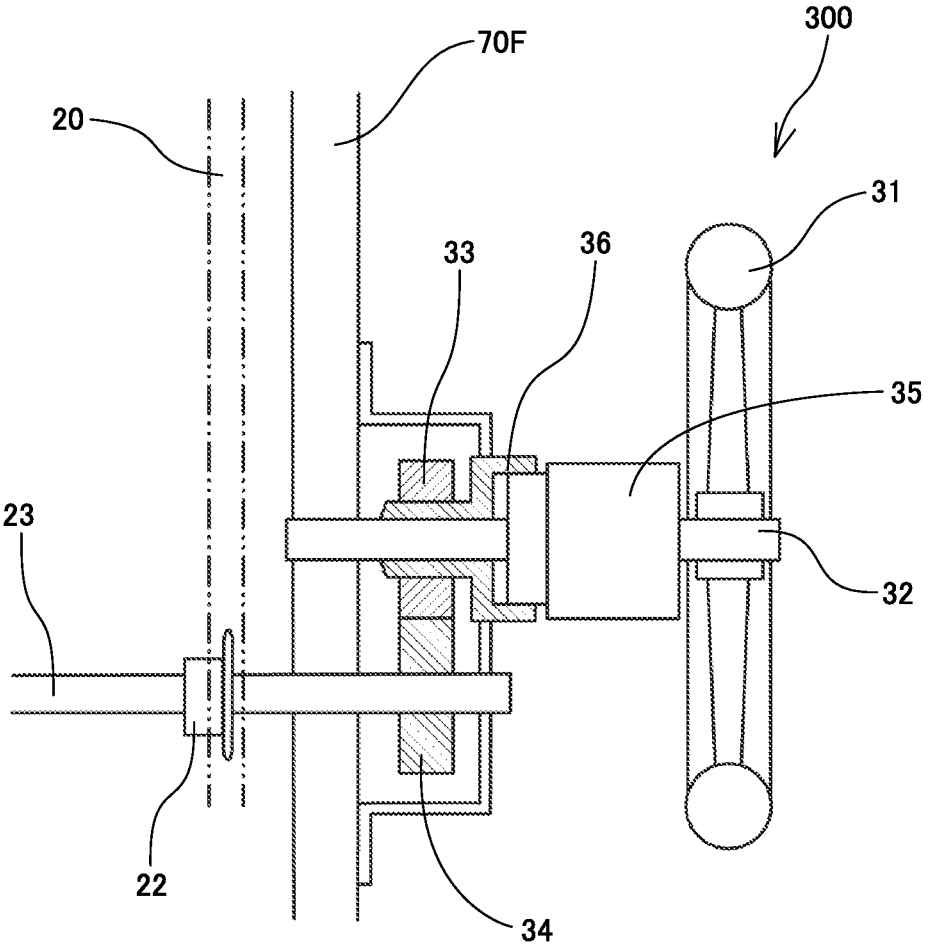
FIG. 5 is an enlarged schematic cross-sectional view of an operation part.

Next, the web loader 200 according to a first embodiment of the present disclosure is described with reference to FIGS. 3 to 5. FIG. 3 is a schematic cross-sectional view of the web loader 200 according to the first embodiment. FIG. 4 is a schematic plan view of a main part of the web loader 200. FIG. 5 is an enlarged schematic cross-sectional view of an operation part.

The web loader 200 includes an endless traction member 20 such as a chain, a plurality of driven sprockets 21, a drive sprocket 22 as a drive rotation body, a holding shaft 40 (holding bar) as a web holder, an operation part 300, and the like.

The traction members 20 are arranged between a loading path 201 and an evacuation path 202 so that the traction members 20 can travel between the loading path 201 and the evacuation path 202. The loading path 201 is used to load the continuous sheet 110. The evacuation path 202 is used to evacuate the holding shaft 40 during a printing operation. The loading path 201 is substantially the same as the conveyance path 120 of the continuous sheet 110 inside the dryer 104 as illustrated in FIG. 2 as described above. Thus, the loading path of the continuous sheet 110 (web) is a nonlinear path.

As illustrated in FIG. 4, the traction members 20 are respectively arranged inside the front-side plate 70F and inside the rear-side plate 70R of the dryer 104 so that the traction members 20 are arranged at both sides of the loading path 201 and the evacuation path 202 of the continuous sheet 110, respectively. The front-side plate 70F and the rear-side plate 70R support the shafts of such as the heating rollers 11 and the heating drum 12 as described above.

The plurality of driven sprockets 21 rotates according to a travel of the traction member 20 and to cause the traction members 20 to follow the loading path 201 and the evacuation path 202.

The drive sprockets 22 are respectively attached to both ends of the drive shaft 23 and engage with the traction members 20 to cause the traction members 20 to travel. The web loader 200 in the first embodiment includes the drive sprockets 22 at an upper center of the web loader 200, but the location of the drive sprockets 22 are not limited to the upper center of the web loader 200.

The operation part 300 applies a driving force to rotate the drive shaft 23 and the drive sprocket 22 to move the traction member 20.

As illustrated in FIG. 5, the operation part 300 includes an operation handle 31 manually rotated, and a gear 33 is connected to a shaft 32 of the operation handle 31 via a torque limiter 35 serving to limit a driving force applied to the drive sprocket 22. The gear 33 engages with a gear 34 fixed to the drive shaft 23.

An input side (right side in FIG. 5) of the torque limiter 35 is connected to the shaft 32 of the operation handle 31, and the output side (left side in FIG. 5) is connected to a coupling 36 mounted on the shaft 32 so that the coupling 36 is freely rotatable. The gear 33 is attached to the coupling 36.

Thus, the operation handle 31 is rotatably operated to rotatably drive the drive sprockets 22 via the shaft 32, the torque limiter 35, the gear 33, the gear 34, and the drive shaft 23. Rotation of the drive sprockets 22 cause the traction members 20 to travel (move) in a predetermined direction. Since the drive sprockets 22 engaged with the traction members 20 are attached to both ends of the drive shaft 23, phases of the traction members 20 can be synchronized.

When the driving force applied to the drive sprocket 22 by the rotation of the operation handle 31 equals to or larger than a predetermined torque (predetermined value) limited by the torque limiter 35, transmission of the driving force of the operation handle 31 to the drive sprockets 22 is interrupted. Thus, the torque limiter 35 can prevent the driving force equal to or more than the predetermined torque (predetermined value) to be transmitted to the drive sprockets 22.

The holding shaft 40 is detachably attached to the traction member 20 and holds a leading end of the continuous sheet 110 as a web.

Figure 6:
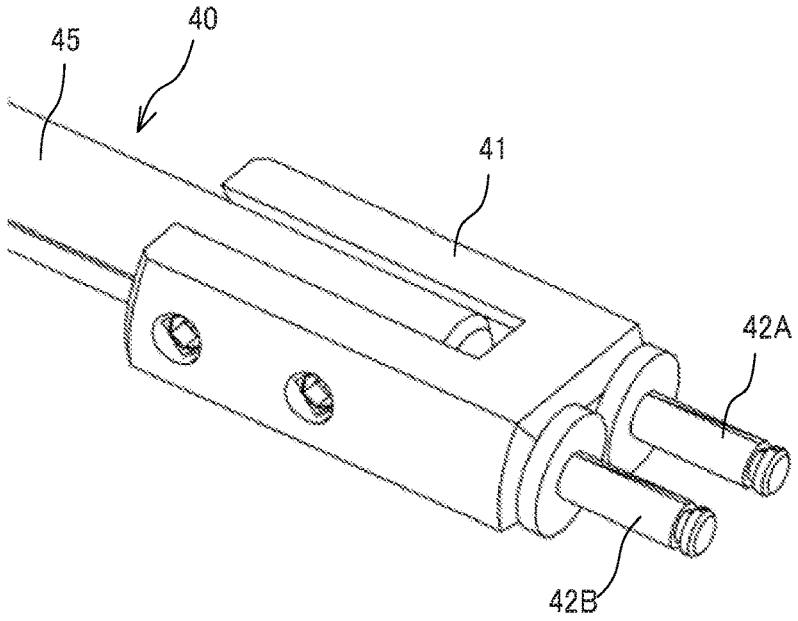
FIG. 6 is a schematic perspective view of an end portion of a holding shaft (web holder)
Figure 7:
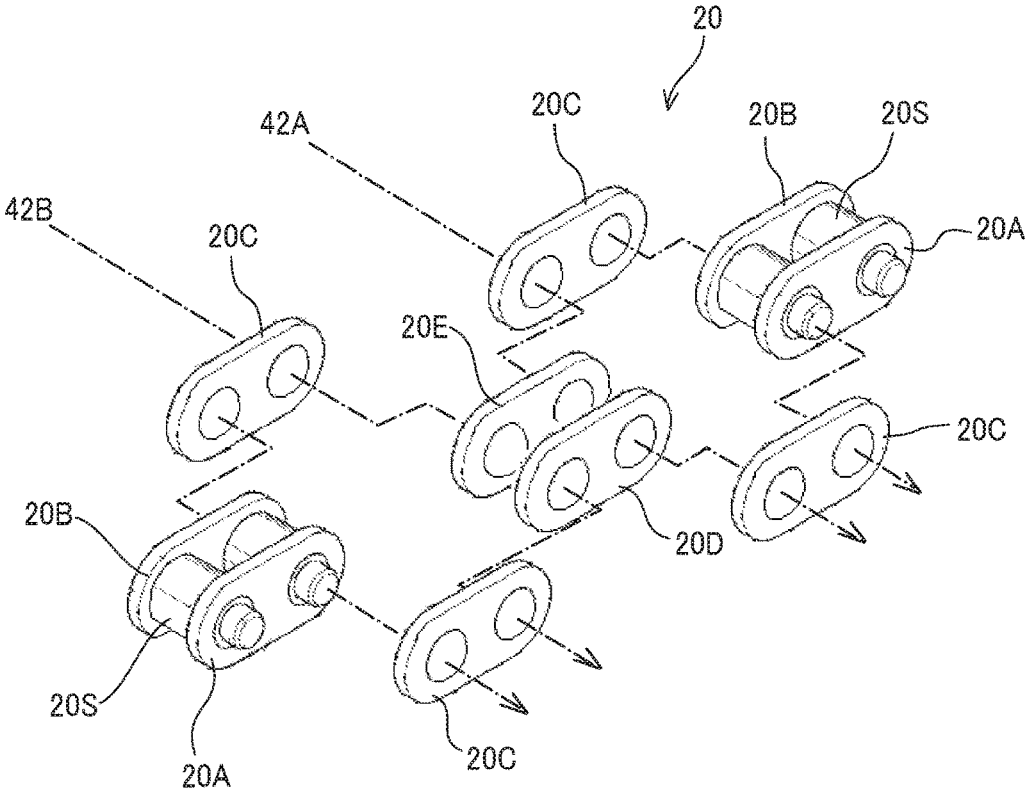
FIG. 7 is an exploded schematic perspective view of a traction member illustrating a configuration of the traction member.

An example of the holding shaft 40 and the traction member 20 is described with reference to FIGS. 6 and 7. FIG. 6 is a schematic perspective view of an end portion of the holding shaft 40. The holding shaft 40 is also referred to as the "web holder." FIG. 7 is an exploded perspective view of the traction member 20 illustrating a configuration of the traction member 20.

The traction member 20 is an endless chain including a plurality of units in which rollers 20S are inserted through the inner plates 20A and 20B. The plurality of units is connected from the outside with outer plates 20C.

The holding shaft 40 includes connecting portions 41 at both ends of the shaft 45 in an axial direction of the shaft 45. The connecting portions 41 include engaging portions 42 (42A and 42B) extending in the axial direction of the shaft 45. The engaging portions 42 (42A and 42B) are inserted through outer plates 20C, inner plates 20E and 20D, and outer plates 20C of the traction member 20. A roller may be provided between the inner plates 20E and 20D to insert the engaging portions 42 (42A and 42B).

In the traction member 20, the recesses of the driven sprocket 21 and the drive sprocket 22 are engaged with the rollers 20S. The rotation of the drive sprocket 22 causes the traction member 20 to move in a predetermined direction while rotating the driven sprocket 21.

Next, an example of loading of the continuous sheet 110 is described below.

First, the operation handle 31 is rotated to raise the holding shaft 40 waiting in the evacuation path 202 and move the holding shaft 40 to a vicinity of the guide roller 17A. Then, a leading end of the continuous sheet 110 is attached to the holding shaft 40 with an adhesive tape or the like.

When the operation handle 31 is rotated again, the holding shaft 40 moves in a direction toward the guide roller 17B from the guide roller 17A along a traveling path of the traction member 20, passes through an outer periphery of each of the plurality of heating rollers 11, and travel around an outer periphery of the heating drum 12.

Then, the holding shaft 40 turns around an outside of the guide roller 17C, alternately travels between the guide rollers 13 and the heating rollers 11, and travels in an order of the guide roller 13J, the guide rollers 17D, 17E, and 17F.

After the continuous sheet 110 is removed from the holding shaft 40, the continuous sheet 110 is moved in an order of the guide rollers 17G, 17H, and 17I while pulling the continuous sheet 110. When the loading of the continuous sheet 110 is completed up to the guide roller 17I, the continuous sheet 110 is wound around each roller as illustrated in FIG. 2.

The holding shaft 40 extends in a width direction of the continuous sheet 110. However, the continuous sheet 110 can be loaded to the dryer 104 and can travel through the conveyance path in the dryer 104 while the holding shaft 40 does not contact with the guide rollers 17, the heating rollers 11, and the guide rollers 13 even if the loading path 201 and the conveyance path 120 are substantially identical since the dryer 104 does not include a roller to nip the continuous sheet 110 in the conveyance path 120.

Next, an operation of the web loader 200 according to the first embodiment is described below.

As illustrated in FIG. 2, the dryer 104 includes a plurality of rollers (guide rollers 13 and heating rollers 11) facing front and back surfaces of the continuous sheet 110. The plurality of rollers (the guide rollers 13 and the heating rollers 11) are arranged around the heating drum 12.

Thus, it is difficult to wind and load the continuous sheet 110 on the heating rollers 11 while passing the continuous sheet 110 through a winding (meandering) heating conveyance path between the heating rollers 11 and the guide rollers 13 with pulling a leading end of the continuous sheet 110 by hand when the continuous sheet 110 is initially loaded to the dryer 104. The "winding (meandering) heating conveyance path" is also referred to as "winding (meandering) nonlinear conveyance path."

It also becomes difficult to wind the continuous sheet 110 around the heating drum 12 through a space between the heating drum 12 and the hot air fans 16 while pulling the leading end of the continuous sheet 110 by hand when the hot air fans 16 are arranged around the heating drum 12 to blow air around the heating drum 12.

Thus, the dryer 104 according to the first embodiment includes the web loader 200. Thus, the continuous sheet 110 can be easily loaded to the dryer 104 by holding the leading end of the continuous sheet 110 with the holding shaft 40 and rotating the operation handle 31 so that the continuous sheet 110 is pulled and moved by the traction member 20 along a loading path 201 corresponding to the conveyance path 120.

For example, in a large continuous sheet printer, a diameter of a roll of the continuous sheet 110 is large, and a large pulling force is needed to pull out the continuous sheet 110 from the roll. Thus, the operation handle 31 may be rotated with momentum, or an operator may rotate the operation handle 31 with the momentum while the operator hanging on the operation handle 31.

When the operation handle 31 is rotated with momentum, an excessive force is applied to the joint between the holding shaft 40 and the traction member 20. Thus, the holding shaft 40 may be bent or broken, or jumping of gear tooth may occur in which the traction member 20 detaches (separates) from the drive sprocket 22.

Further, the conveyance path 120 includes a bent heating conveyance path including the heating rollers 11 and the guide rollers 13 facing the back and front surfaces of the continuous sheet 110. Thus, a load to load the continuous sheet 110 in the winding (meandering) conveyance path 120 is higher than a load to load the continuous sheet 110 in a straight conveyance path.

Thus, if the operation handle 31 is forcibly continued to rotate, the holding shaft 40 bends, and the bent holding shaft 40 comes into contact with the guide rollers 13 and the heating rollers 11. Therefore, it may be difficult to load the continuous sheet 110 smoothly. Further, when the bending of the holding shaft 40 increases, the holding shaft 40 may come off from the traction member 20.

To reduce bending of the holding shaft 40, it is possible to increase a diameter of the holding shaft 40 that increase a strength of the holding shaft 40. However, there is a limit in increasing the diameter of the holding shaft 40 because of a positional relationship between the guide roller 13 and the heating roller 11.

Therefore, the web loader 200 in the present embodiment includes the torque limiter 35 as a means to restrict a driving force on a path that transmits rotation of the operation handle 31 to the traction member 20.

Thus, the torque limiter 35 prevents a driving force equal to or more than a predetermined force to be transmitted to the drive sprocket 22 that causes the traction member 20 to travel. Thus, the web loader 200 can stably load the continuous sheet 110 without bending or damaging the holding shaft 40, coming off of the holding shaft 40 from the traction member 20, or the like.

Here, an example of an operation torque of the torque limiter 35 is described with reference to FIG. 8.

FIG. 8 is a table illustrating a result of variously changing the operating torque of the torque limiter 35 and the loading operation confirmed.

From the result as illustrated in FIG. 8, it can be seen that the driving force transmitted to the traction member 20 is preferably set to 450 N to 550 N in the present embodiment when considering whether a sufficient conveyance force is obtained when the continuous sheet 110 is passed through the loading path 201 of the continuous sheet 110, whether the traction member 20 or the holding shaft 40 is damaged when the continuous sheet 110 is operated, and the like. Thus, the torque limiter 35 is configured to cut off transmission of the driving force to the traction member 20 when the driving force becomes 450 N to 550 N.

In other words, the predetermined torque (predetermined value) at which the torque limiter 35 cuts off (interrupts) the transmission of the driving force of the operation handle 31 to the drive sprockets 22 is 450 N to 550 N.

Figure 9:
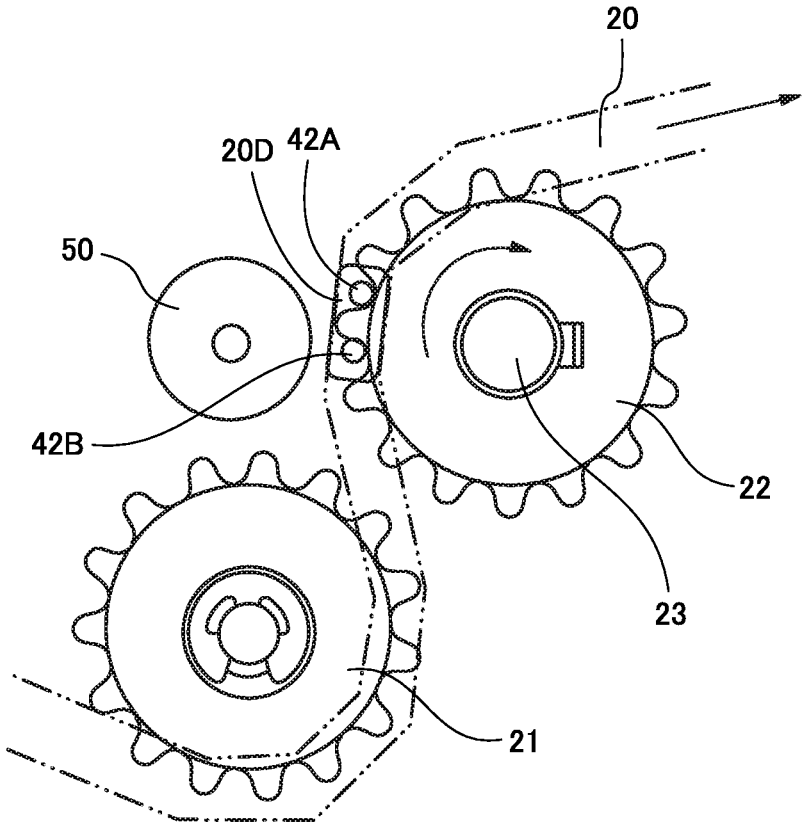
FIG. 9 is a schematic side view in a vicinity of a drive rotation body according to a second embodiment of the present disclosure.
Figure 10:
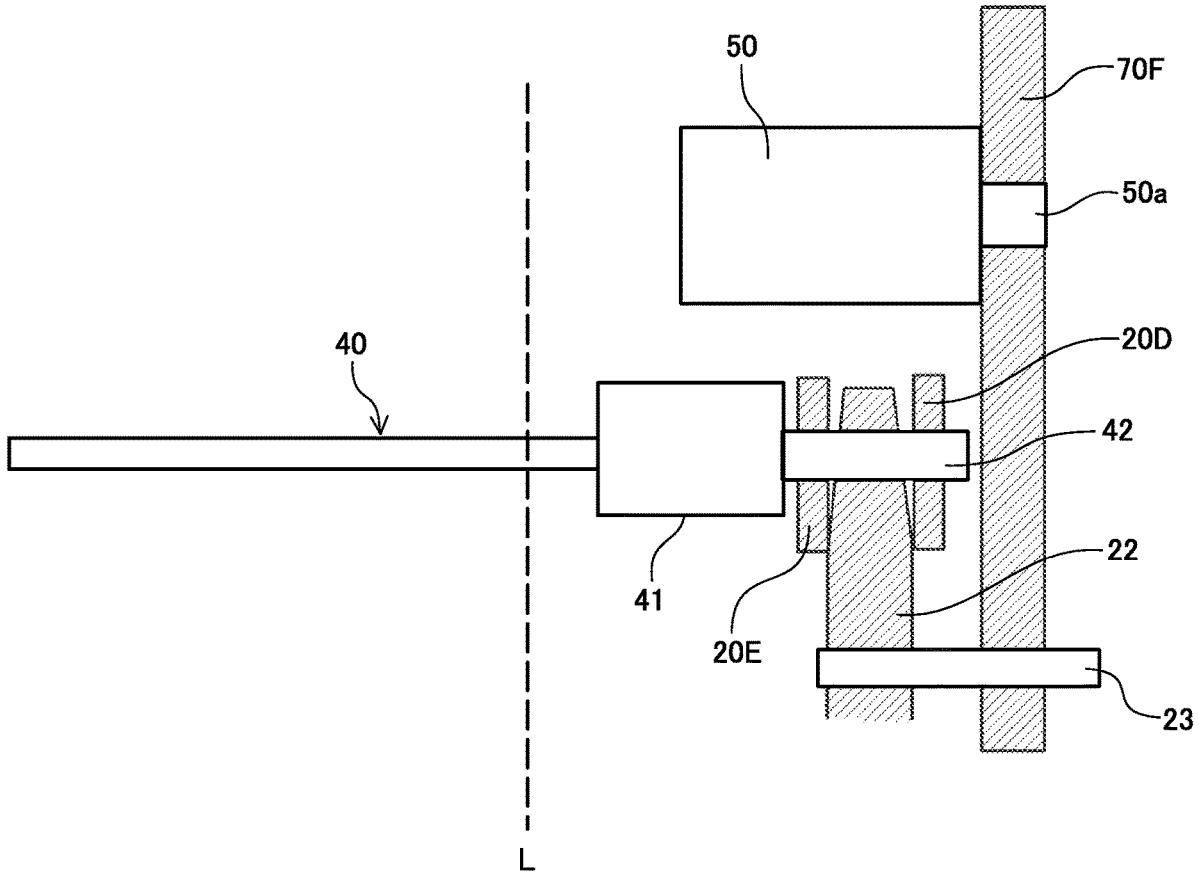
FIG. 10 is a front cross-sectional view of a portion of the drive rotation body.

The web loader 200 according to a second embodiment of the present disclosure is described with reference to FIGS. 9 and 10. FIG. 9 is a schematic side view of a vicinity of the drive rotation body to describe the second embodiment of the present disclosure. FIG. 10 is a front cross-sectional view of a portion of the drive rotation body.

The web loader 200 according to the second embodiment includes a restriction member 50 as a means (detachment prevention means) to prevent detachment (separation) of the traction member 20 from the drive sprocket 22, which is a drive rotation body that applies a driving force to the traction member 20.

The web loader 200 includes the restriction member 50 in a vicinity of a position between the drive sprocket 22 (drive rotation body) and the driven sprocket 21 (driven rotation body) closest to the drive sprocket 22 on an upstream side of the drive sprocket 22 in a traveling direction (moving direction) of the traction member 20.

The restriction member 50 is, for example, cylindrical and one end 50*a* is fixed to the front-side plate 70F. One end 50*a* of the restriction member 50 and the front-side plate 70F may be fixed by fitting. Further, fixing of one end 50*a* of the restriction member 50 to the front-side plate 70F may have a configuration in which one end 50*a* of the restriction member 50 having a screw-shape is screwed and fastened to the front-side plate 70F.

Thus, the web loader 200 can stably load the continuous sheet 110 without detachment of the traction member 20 from the drive sprocket 22 that disables the pulling of the holding shaft 40.

Figure 11A:
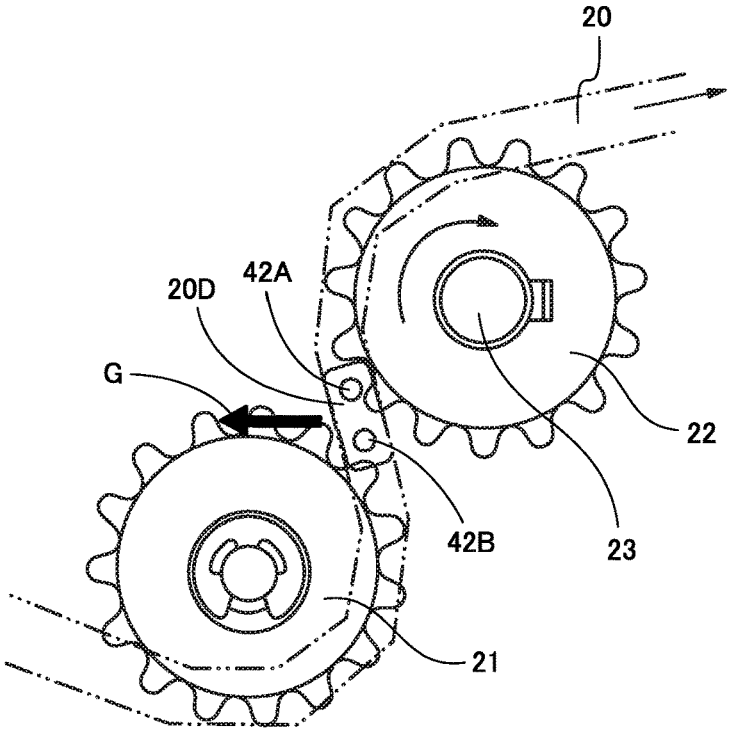
FIGS. 11A and 11B are schematic side views of the vicinity of the drive rotation body illustrating a detachment of the traction member.
Figure 11B:
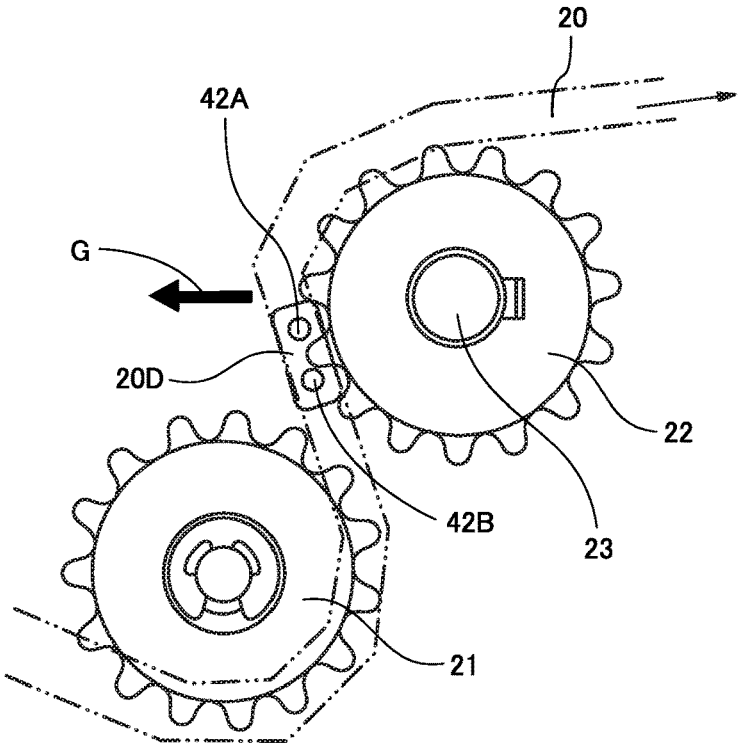
Figure 12:
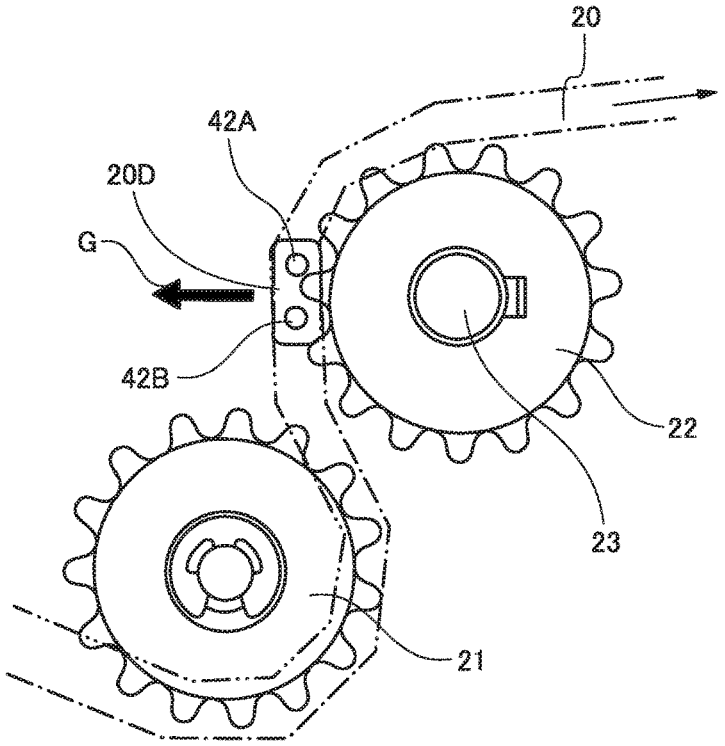
FIG. 12 is a schematic side view in the vicinity of the drive rotation body illustrating the detachment of the traction member.

Detachment of the traction member 20 in a configuration without the restriction member 50 is described with reference to FIGS. 11A and 11B, and FIG. 12. FIGS. 11A and 11B, and FIG. 12 are schematic side views of the vicinity of the drive rotation body without the restriction member 50.

In a configuration in which the guide rollers 13 and the heating rollers 11 are alternately arranged on the front and back side of the continuous sheet 110 (web) to form the winding (meandering) conveyance path as in the above-described dryer 104, a stronger force is applied to the traction member 20, particularly, when loading a thick paper as compared with loading a thin paper. Therefore, a phenomenon occurs in which the traction member 20 accumulates on the downstream side of the drive sprocket 22.

FIG. 11A illustrates a state in which the operation handle 31 is rotated to rotate the drive sprocket 22 in a direction indicated by arrow, and the traction member 20 moves so that an engaging portion 42A of the holding shaft 40 enters a recess between teeth of the drive sprocket 22.

Since the leading end of the continuous sheet 110 is attached to the holding shaft 40 with an adhesive tape or the like, the holding shaft 40 and the traction member 20 are pulled in a direction indicated by arrow "G" by the load at the time of loading of the continuous sheet 110. Further, a large driving tension is generated in the traction member 20.

Therefore, a frictional force is generated between the roller 20S of the traction member 20 and tooth surface of the drive sprocket 22 when the operation handle 31 is further rotated. As illustrated in FIGS. 11B and 12, the traction member 20 moves in a state in which the roller 20S is not sufficiently inserted into the recess of the drive sprocket 22. Specifically, the traction member 20 moves in a state in which a recess between the tooth tops (addendums) of the drive sprocket 22 and the engaging portion 42A of the holding shaft 40 is not engaged.

Therefore, when the holding shaft 40 passes through the drive sprocket 22, the jumping of gear tooth may occur, in which the holding shaft 40 detaches (separates) from the drive sprocket 22, and the holding shaft 40 may deviate from a correct web loading path 201.

Therefore, the web loader 200 in the second embodiment as described above includes the restriction member 50 in the vicinity of the position at which the drive sprocket 22 start to engage with the roller 20S (see FIG. 7) of the traction member 20.

Therefore, even if the inner plates 20E and 20D of the traction member 20 move in a direction away from the drive sprocket 22 due to a rotation drive of the drive sprocket 22, a movement of the inner plates 20E and 20D is restricted by the restriction member 50. Thus, the restriction member 50 can prevent the jumping of gear tooth in which the traction member 20 detaches (separates) from the drive sprocket 22.

Another end (left end in FIG. 10) of the restriction member 50 is positioned outside the maximum width "L" (see broken line in FIG. 10) of the continuous sheet 110 (web). Therefore, even if the inner plates 20E and 20D of the traction member 20 move in the direction away from the drive sprocket 22, the contact between the continuous sheet 110 attached to the holding shaft 40 and the restriction member 50 can be avoided. Thus, the restriction member 50 can reduce damage on the continuous sheet 110 (web).

Figure 13:
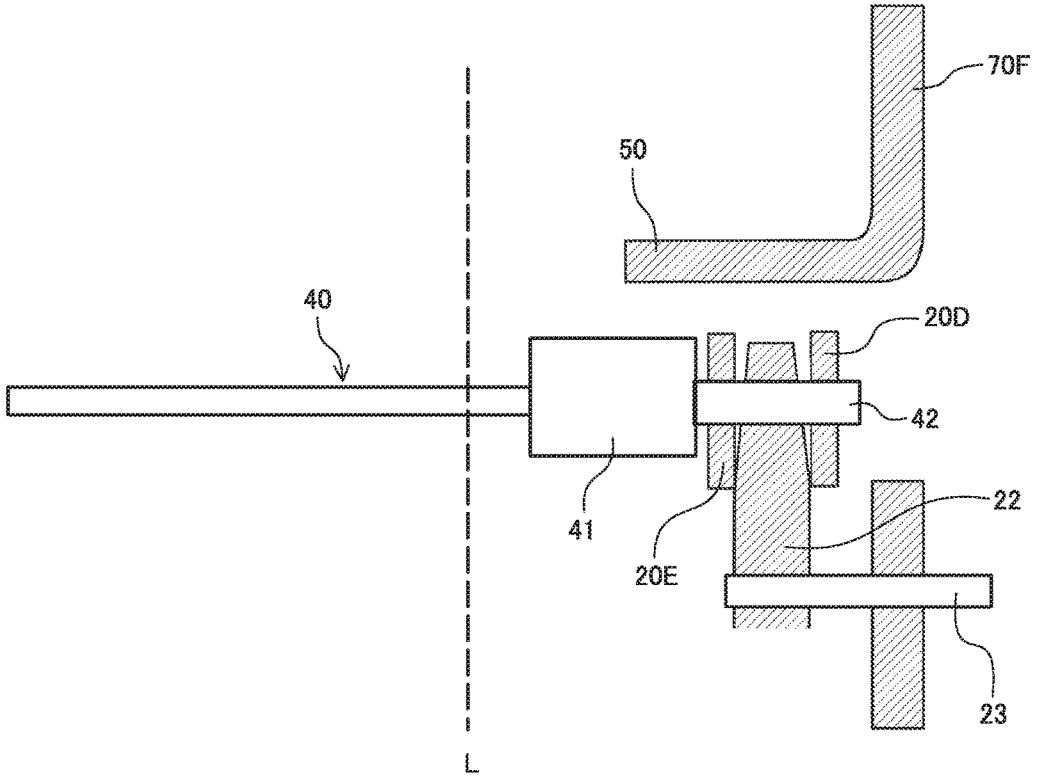
FIG. 13 is a schematic front cross-sectional view in a vicinity of the drive rotation body according to a third embodiment of the present disclosure.

A third embodiment according to the present disclosure is described with reference to FIG. 13. FIG. 13 is a schematic front cross-sectional view of the vicinity of the drive rotation member illustrating the third embodiment of the present disclosure.

The web loader 200 according to the third embodiment includes the restriction member 50 and the front-side plate 70F formed together as a single body in which the restriction member 50 is formed by bending a part of the front-side plate 70F.

Thus, the web loader 200 according to the third embodiment can obtain a similar operational effect with the operational effect of the second embodiment. At the same time, an operation of attaching the restriction member 50 to the web loader 200 is not necessary so that the restriction member 50 does not fall off from the web loader 200.

Figure 14:
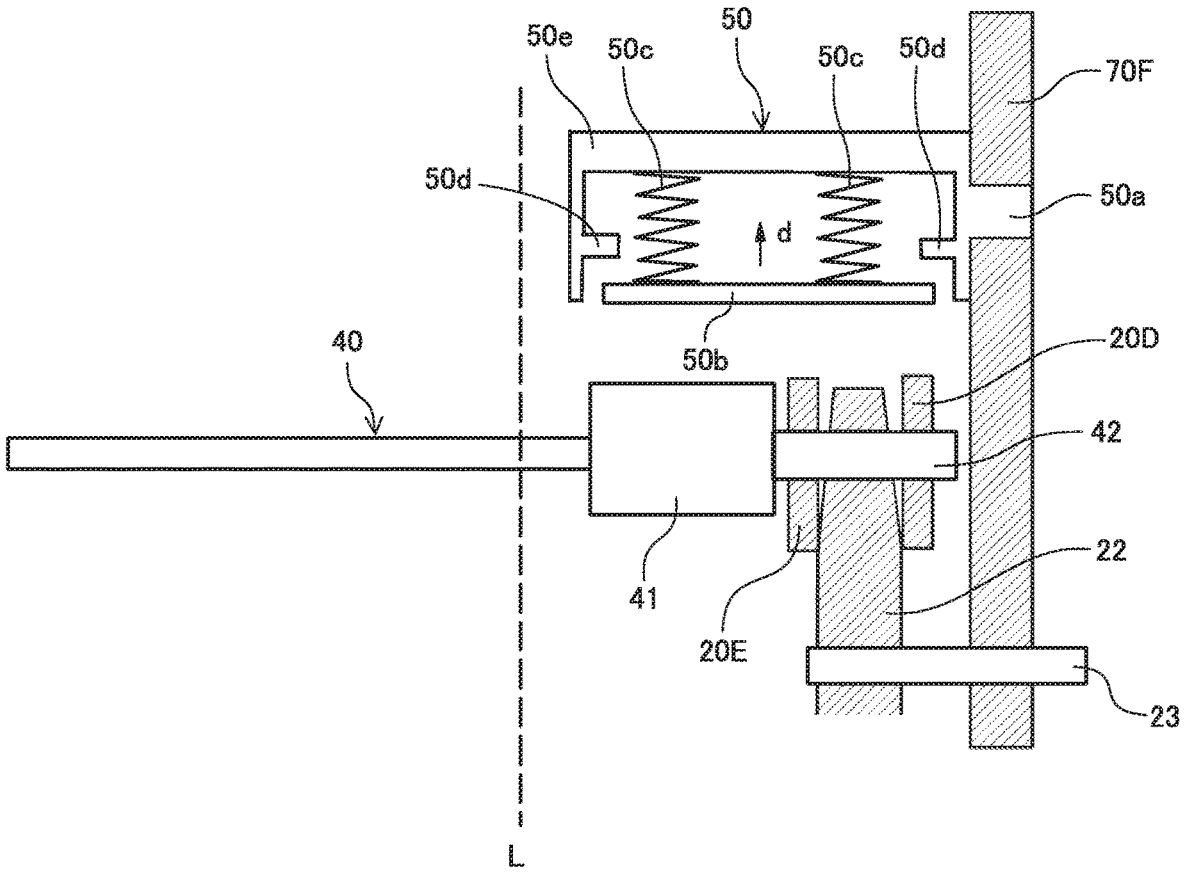
FIG. 14 is a schematic front cross-sectional view in a vicinity of the drive rotation body according to a fourth embodiment of the present disclosure.

A fourth embodiment according to the present disclosure is described with reference to FIG. 14. FIG. 14 is a schematic front cross-sectional view of a vicinity of the drive rotation member illustrating the fourth embodiment of the present disclosure.

The web loader 200 according to the fourth embodiment includes the restriction member 50 that includes a restriction receiving surface 50*b*, biasing members 50*c* (springs), and a restriction protrusion 50*d*.

The restriction receiving surface 50*b* is attached to one end of the biasing members 50*c* having another end fixed to the case 50*e*. The restriction receiving surface 50*b* is movably held at a position facing the traction member 20 and the connecting portions 41 while the restriction receiving surface 50*b* is separate from the traction member 20 and the connecting portions 41. The biasing member 50*c* applies a reaction force to the restriction receiving surface 50*b* when the restriction receiving surface 50*b* is moved in a direction indicated by arrow "d". The restriction protrusion 50*d* is formed on a case 50*e*. The restriction protrusion 50*d* restricts the restriction receiving surface 50*b* not to move above a predetermined position at the restriction protrusion 50*d*.

With such a configuration, the restriction receiving surface 50*b* faces and separates from the traction member 20 and the connecting portion 41 in a normal state and receives the traction member 20 detached (separated) from (or about to separate from) the drive sprocket 22.

When the traction member 20 comes into contact with the restriction receiving surface 50*b*, the biasing member 50*c* applies a force to the traction member 20 in a direction opposite to the ascending direction (separation direction) of the traction member 20 to restricts an ascent (separation) of the traction member 20 from the drive sprocket 22. When a force greater than the force of the biasing member 50*c* is applied to the restriction receiving surface 50*b*, the restriction protrusion 50*d* restricts the elevation of the restriction receiving surface 50*b*.

Thus, the web loader 200 according to the third embodiment can obtain a similar operational effect with the operational effect of the second embodiment. At the same time, an operation of attaching the restriction member 50 to the web loader 200 is not necessary so that the restriction member 50 does not fall off from the web loader 200.

A fifth embodiment according to the present disclosure is described with reference to FIG. 15.

Figure 15:
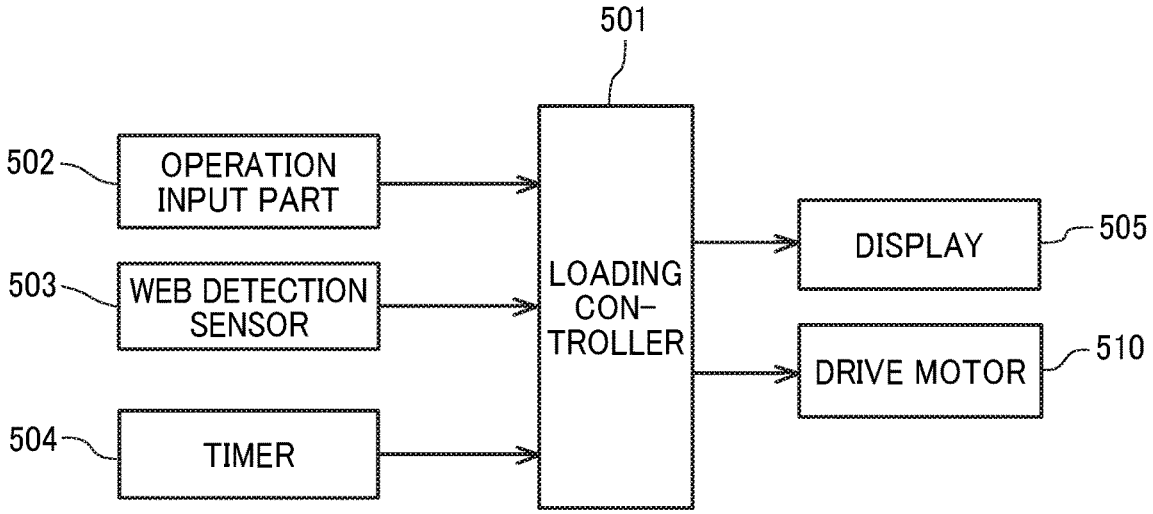
FIG. 15 is a circuit diagram related to a drive control of the web loader according to a fifth embodiment of the present disclosure.

FIG. 15 is a circuit diagram related to a drive control of the web loader 200 according to a fifth embodiment of the present disclosure.

The web loader 200 in the fifth embodiment includes a drive motor 510. An output shaft of the drive motor 510 is connected to the torque limiter 35 instead of the operation handle 31 as illustrated in FIG. 5.

The loading controller 501 receives each signal of an operation input part 502, a web detection sensor 503, and a timer 504 and controls to drive the drive motor 510 and controls a loading operation of the continuous sheet 110 as a web. The loading controller 501 outputs and displays necessary information on the display 505.

When a start of loading is selected by the operation input part 502 by a liquid crystal screen or the like, the loading controller 501 receives a loading start signal and controls to start driving the drive motor 510. The drive motor 510 starts driving to move the traction member 20 along the conveyance path as described in the first embodiment so that the loading operation of the continuous sheet 110 (web) starts.

The web detection sensor 503 is disposed at a predetermined position in the loading path 201 of the web loader 200. The web detection sensor 503 detects that a leading end of the continuous sheet 110 (leading end of the web) has passed the web detection sensor 503.

When a load at the time of loading the continuous sheet 110 (web) is high, a driving force transmitted from the drive motor 510 to the drive rotation body (drive sprocket 22) is cut off by the torque limiter 35 as described above. Thus, the continuous sheet 110 stops traveling.

If the web detection sensor 503 does not detect the continuous sheet 110 (web) for a predetermined time (measured by the timer 504) after start driving the driving motor 510, the loading controller 501 stops driving the drive motor 510 and display a loading error on an output screen of the display 505.

Thus, the web loader 200 can obtain the same operational effect as the operational effect in the first embodiment, and the loading operation of the continuous sheet 110 (web) is further simplified.

If the web loader 200 includes a detector to detect a driving load, the loading controller 501 can determine that the transmission of driving force is interrupted by the torque limiter 35. Thus, the loading controller 501 can stop the drive motor 510 immediately after detecting interruption of the transmission of the driving force.

Further, the loading controller 501 may drive the drive motor 510 again after a predetermined time has elapsed (measured by the timer 504) since the drive motor 510 stops driving without outputting and displaying a loading error on the display 505. The loading controller 501 may display the loading error on the output screen of the display 505 when the continuous sheet 110 stops travel even when the drive motor 510 drives again.

Further, the web loader 200 may include both the operation handle 31 as described in the first embodiment and the drive motor 510 in the present embodiment. For example, when a loading error is displayed on the output screen of the display 505, the loading controller 501 switches the loading operation from a loading operation by the drive motor 510 to a loading operation by the operation handle 31 to continue the loading operation. Further, when start of the loading operation is selected at the operation input part 502, the loading controller 501 may shift the loading operation from the loading operation by the operation handle 31 to the loading operation by the drive motor 510 when the web passes a position at which the drive load is high by the loading operation of the operation handle 31.

In each of the embodiments described above, an example is described in which the web is continuous sheet. However, the web is not limited to the continuous sheet. For example, the web may be a continuous body such as continuous sheet, roll paper, a recording medium (object to be printed) such as long sheet material, wallpaper, sheet for electronic circuit board, or the like.

Further, the web loader 200 in the above-described embodiments can be applied to a conveyor including a plurality of rotating bodies to convey a web. If the web loader 200 configures the conveyor, the web is not necessary to be heated. Thus, the conveyor includes a drive rotation body such as a drive roller to apply a conveyance force to the web without a heater to heat the web.

The printer may print recording images such as characters and figures with a liquid such as ink on a web. Further, the printer may print an arbitrary image such as a pattern on the web with a liquid such as ink on the web for decoration.

Herein, the liquid to be applied to a web is not particularly limited, but it is preferable that the liquid has a viscosity of less than or equal to 30 mPa·s under a normal temperature and a normal pressure or by being heated or cooled. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

When a liquid discharge head is used as a liquid application unit, examples of an energy generation source to discharge a liquid include an energy generation source using a piezoelectric actuator (a lamination piezoelectric element and a thin-film piezoelectric element), a thermal actuator using an electrothermal transducer element such as a heating resistor, a static actuator including a diaphragm plate and opposed electrodes, and the like.

The terms "printing" in the present embodiment may be used synonymously with the terms of "image formation", "recording", "printing", and "image printing".

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A web loader comprising:

a web holder configured to hold a web;

a traction member configured to hold the web holder and travel along a loading path of the web;

a drive rotation body configured to drive the traction member to travel; and a limiter disposed between a rotatable shaft and the drive rotation body, and configured to limit a drive force applied to the drive rotation body by rotation of the rotatable shaft.

2. The web loader according to claim 1, wherein the limiter interrupts a transmission of the drive force to the drive rotation body when the drive force is equal to or larger than a predetermined value.

3. The web loader according to claim 2, wherein the predetermined value of the drive force is in the range from 450 N to 550 N.

4. The web loader according to claim 1, further comprising:

an operation part configured to rotate the drive rotation body; and the operation part includes the rotatable shaft and the limiter.

5. The web loader according to claim 4, wherein:

the operation part includes an operation handle connected to the rotatable shaft, and configured to be manually rotated.

6. The web loader according to claim 5, wherein:

the drive rotation body comprises a drive sprocket connected to a drive shaft, and configured to engage the traction member;

the operation part further includes a second gear that engages a first gear fixed to the drive shaft; and the second gear is connected to the rotatable shaft via the limiter.

7. The web loader according to claim 4, wherein:

the operation part includes a drive motor comprising the rotatable shaft.

8. The web loader according to claim 1, wherein the loading path of the web is a nonlinear path.

9. The web loader according to claim 1, further comprising a restriction member configured to restrict detachment of the traction member from the drive rotation body.

10. A conveyer comprising:

a plurality of rotating bodies configured to convey the web; and the web loader according to claim 1.

11. A dryer comprising:

a plurality of rotating bodies configured to convey the web; and the web loader according to claim 1, wherein the plurality of rotating bodies includes at least one heating rotating body configured to heat the web.

12. A printer comprising:

a liquid application device configured to apply liquid on the web; and the dryer according to claim 11.

13. A web loader comprising:

a web holder configured to hold a web;

a traction member configured to hold the web holder and travel along a loading path of the web;

a drive sprocket attached to a drive shaft, and configured to drive the traction member to travel;

an operation handle configured to apply a drive force to rotate the drive sprocket to move the traction member; and a limiter disposed between the operation handle and the drive sprocket, and configured to limit the drive force applied to the drive sprocket by rotation of the operation handle.

14. The web loader according to claim 13, wherein the limiter interrupts a transmission of the drive force to the drive sprocket when the drive force is equal to or larger than a predetermined value.

15. The web loader according to claim 14, wherein the predetermined value of the drive force is in the range from 450 N to 550 N.

16. The web loader according to claim 13, wherein:

the operation handle is connected to a rotatable shaft;

a second gear of the web loader engages a first gear fixed to the drive shaft; and the second gear is connected to the rotatable shaft via the limiter.

17. The web loader according to claim 13, wherein:

the web holder comprises a holding shaft having connecting portions at both ends of the holding shaft in an axial direction configured to engage the traction member; and a leading end of the web is attached to the holding shaft.

18. The web loader according to claim 13, further comprising:

a restriction member configured to restrict detachment of the traction member from the drive sprocket.

19. A dryer comprising:

a plurality of rotating bodies configured to convey the web; and the web loader according to claim 13, wherein the plurality of rotating bodies includes at least one heating rotating body configured to heat the web.

20. A printer comprising:

a liquid application device configured to apply liquid on the web; and the dryer according to claim 19.

* * * * *